US012605759B2

(12) United States Patent
Bahurudeen et al.

(10) Patent No.: US 12,605,759 B2
(45) Date of Patent: Apr. 21, 2026

(54) AUTOLOADING RIVET INSTALLER WITH DEBRIS COLLECTION

(71) Applicant: The Boeing Company, Arlington, VA (US)

(72) Inventors: Shalini Bahurudeen, Bangalore (IN); Gerald Garten, West Grove, PA (US)

(73) Assignee: The Boeing Company, Arlington, VA (US)

( * ) Notice: Subject to any disclaimer, the term of this patent is extended or adjusted under 35 U.S.C. 154(b) by 40 days.

(21) Appl. No.: 18/501,759

(22) Filed: Nov. 3, 2023

(65) Prior Publication Data

US 2025/0144701 A1 May 8, 2025

(51) Int. Cl.
*B21J 15/32* (2006.01)
*B21J 15/10* (2006.01)

(52) U.S. Cl.
CPC ..... *B21J 15/326* (2013.01); *B21J 15/105* (2013.01)

(58) Field of Classification Search
CPC ..... B21J 15/30; B21J 15/326
See application file for complete search history.

(56) References Cited

U.S. PATENT DOCUMENTS 4,059,981 A * 11/1977 Holloway ..... B21J 15/34 72/453.17
4,205,547 A * 6/1980 Yamasaka ..... B21J 15/105 227/51
4,604,889 A * 8/1986 Sukharevsky ..... B21J 15/105 227/112
4,747,294 A * 5/1988 Schwartz ..... B21J 15/32 227/51
4,754,643 A * 7/1988 Weeks, Jr. ..... B21J 15/285 227/112
5,035,353 A * 7/1991 Smart ..... B21J 15/32 227/3
5,100,023 A * 3/1992 Varian ..... B21J 15/105 221/258
5,123,162 A * 6/1992 Wing ..... B21J 15/32 29/818
5,239,900 A * 8/1993 Macris ..... B25B 23/04 81/433
6,240,613 B1 * 6/2001 O'Connor ..... B21J 15/32 29/709
11,364,579 B2 * 6/2022 Lang ..... F16B 19/05
2004/0205950 A1 * 10/2004 Schmitt ..... B21J 15/32 227/119

(Continued)

*Primary Examiner* — Kyle A Cook
(74) *Attorney, Agent, or Firm* — Kolitch Romano Dascenzo Gates LLP

(57) ABSTRACT

Tools and methods are disclosed for automatically capturing debris generated during rivet installation using an autoloading rivet gun. In some examples, an autoloading rivet installation device includes a hand-held rivet gun and an automatic loader which uses a first actuator having a shaft oriented parallel to a longitudinal plane of the rivet gun. A second actuator is coupled to the rivet gun and has an orientation orthogonal to the first actuator, such that the second actuator is configured to transition a magnet laterally between a plurality of positions relative to the longitudinal plane to capture ferromagnetic debris. The magnet may, for example, be disposed on a load arm of the loader, and the second actuator may be configured to translate the loader's first actuator from side to side.

17 Claims, 6 Drawing Sheets

(56) References Cited

U.S. PATENT DOCUMENTS

| | | | | |
|---|---|---|---|---|
| 2007/0157449 | A1* | 7/2007 | Neal | B21J 15/32 227/120 |
| 2007/0295779 | A1* | 12/2007 | Fulbright | B21J 15/32 227/138 |
| 2016/0008933 | A1* | 1/2016 | Long | B23P 19/001 221/1 |
| 2017/0182546 | A1* | 6/2017 | Sun | B21J 15/28 |
| 2023/0131707 | A1* | 4/2023 | Stalcup | B21J 15/142 227/53 |
| 2023/0415315 | A1* | 12/2023 | Li | B25C 1/008 |

* cited by examiner

AUTOLOADING RIVET INSTALLER WITH DEBRIS COLLECTION

FIELD

This disclosure relates to systems and methods for installing rivets. Specifically, the disclosure relates to improved auto-loading blind rivet guns.

BACKGROUND

During manufacturing or assembling of parts, two or more components may need to be fastened together. One option to do such fastening is rivets. Designed to permanently fasten the parts, the shapes of rivets deform to fill a hole or gap shared by two or more components. There exist a variety of rivet types, with one such type being blind rivets. Blind rivets are designed for applications where only one side of a hole may be accessed, may be used with a rivet gun. Blind rivets typically comprise of a head portion connected to a stem portion. The steam portion is pulled on by the rivet gun, deforming the head portion because of the connection between the stem portion and the head portion. Upon sufficiently deforming the head portion, the stem is severed and/or clipped from the rivet, either through the pulling motion or through the rivet gun being equipped to sever the stem. Because of how rivets are designed, certain parts of the rivet, like the stem, are discarded after the rivet is installed. These discarded parts can form debris in a workspace.

SUMMARY

Tools and methods for automatically capturing debris generated during rivet installation using an autoloading rivet installation device are disclosed herein. In some examples, an autoloading rivet installation device includes: a hand-held rivet gun; an automatic loader configured to load rivets into an end of the rivet gun using a first actuator having a shaft oriented parallel to a longitudinal plane of the rivet gun; and a second actuator coupled to the rivet gun and having an orientation orthogonal to the first actuator, wherein the second actuator is configured to transition a magnet laterally between a plurality of positions relative to the longitudinal plane to capture ferromagnetic debris.

In some examples, an autoloading rivet installation device includes: a rivet gun defining a longitudinal plane; a loading arm coupled to a first actuator, wherein the loading arm is configured to load rivets into a nose of the rivet gun, wherein the first actuator is configured to extend and retract the loading arm parallel to the longitudinal plane; and a second actuator coupled to the rivet gun, wherein the second actuator is configured to translate the first actuator in directions orthogonal to the longitudinal plane.

In some examples, a method of using an rivet gun includes: retrieving a rivet from an onboard rivet dispenser using a load arm coupled to a first actuator of a rivet gun; loading the rivet into an end of the rivet gun using the load arm and the first actuator; transitioning the load arm of the automatic loader to a position away from the end of the rivet gun using the first actuator; and in response to installation of the rivet by the rivet gun, retrieving an item of ferromagnetic debris using a magnet coupled to the load arm by automatically repositioning the load arm in a lateral direction using a second actuator oriented orthogonal to the first actuator.

DETAILED DESCRIPTION

Figure 1:
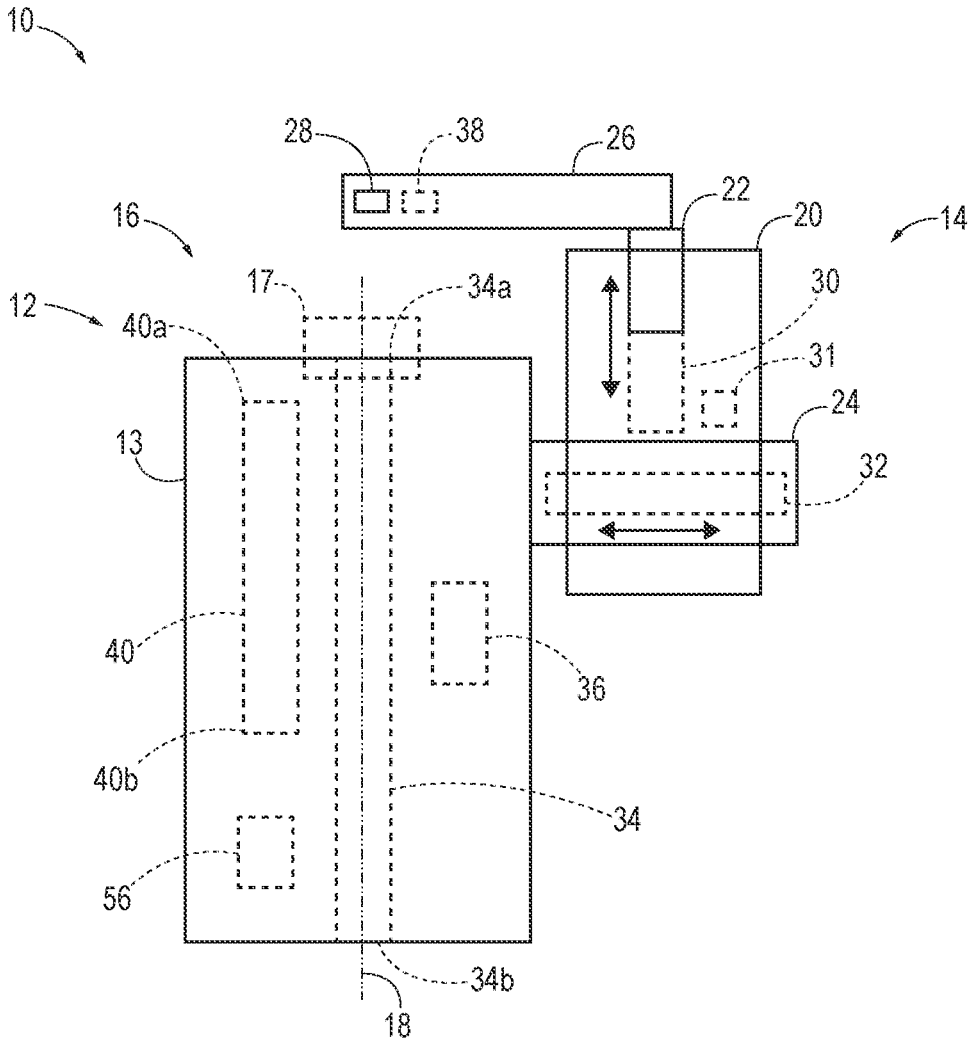
FIG. 1 is a schematic diagram of an illustrative autoloading rivet installation device of the present disclosure.

Tools and methods for capturing rivet-related debris are disclosed. Generally, in the figures, elements that are likely to be included in a given example are illustrated in solid lines, while elements that are optional to a given example are illustrated in broken lines. However, elements that are illustrated in solid lines are not essential to all examples of the present disclosure, and an element shown in solid lines may be omitted from a particular example without departing from the scope of the present disclosure. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Description includes the following sections, which follow immediately below: (1) Overview; (2) Examples, Components, and Alternatives; (3) Advantages, Features and Benefits; and (4) Conclusion. The Examples, Components, and Alternatives section is further divided into subsections, each of which is labeled accordingly.

Overview

Automatic rivet guns are used to join parts together effectively and efficiently and are used in a wide variety of fields, including manufacturing of aerospace components. However, operation of rivet guns often results in the generation of debris. Typically, debris comes from unused portions of each rivet that are severed or otherwise removed from the rivet during installation, such as the stem of the rivet or an installation washer. Absent intervention, debris from rivets may fall to the floor or workstation and can interfere with later manufacturing and/or damage parts, tools, etc. Depending on a rivet's material composition, debris from the rivet may be ferromagnetic, that is, attracted to magnets. Systems and methods disclosed herein provide an improved solution to the technical problem of capturing rivet debris by incorporating a positionable magnet on the rivet installation device.

In general, an autoloading rivet installation device of the present disclosure comprises a rivet gun configured to install rivets, and an onboard automatic loader configured to automatically load rivets into the rivet gun. The automatic loader is further configured to automatically (or semiautomatically) capture falling or ejected debris from rivets during and/or after installation of a rivet. The automatic loader comprises a first actuator configured to move a shaft-mounted load arm of the loader forward and backward relative to a body of the rivet gun. The autoloading device further comprises a second actuator configured to move the arm sideways, i.e., toward and away from a longitudinal plane of the body of the rivet gun. The arm includes a magnet configured to capture ferromagnetic debris from the riveting process. In some examples, the arm is positioned at the end of the shaft of the first actuator such that a proximal end of the arm is coupled to the shaft and the magnet is disposed on a distal end of the arm.

The load arm may include a rivet holder configured to temporarily hold a rivet until the rivet is inserted into the rivet gun. The arm may be moved to the front of end and/or a nose of the rivet gun to load rivets into the gun. Once the rivet gun is loaded, the arm may be moved away from the front of the rivet gun. During an installation period (i.e., rivet gun is loaded and prepared to install a rivet), multiple positions are possible to move the arm to. For example, the arm may be positioned to the side of the rivet gun and back from the front end of the rivet gun. In some examples, the arm is positioned above the body of the rivet gun during installation of rivets.

The automatic loader may be configured to have various degrees of freedom. For example, the loader may be configured to move forward, backward, and/or side-to-side with respect to the remainder of the device. In some examples, the loader may have one or more portions that rotate. For example, the shaft may be configured to rotate in response to moving forward and backward, e.g., during extension and retraction. In some examples, the first actuator is coupled (directly or indirectly) to the second actuator and acted upon by the second actuator. For example, the second actuator may be configured to translate the first actuator sideways relative to the body of the rivet gun. workpiece During and/or after the rivet installation process, debris may fall and/or be ejected from the riveting area. In response, or upon user direction or command, the first and/or second actuators can be used to move the arm and its magnet to capture the debris (e.g., in midair). In some examples, repositioning is aided and/or partially or entirely determined using a sensor configured to detect the presence and/or trajectory of the debris. Accordingly, the exact movement to capture debris may vary depending on, but not limited to, the trajectory of debris from rivets, the surrounding work environment (e.g., the workpiece limits sideways motion), the size and shape of debris, etc.

Examples, Components, and Alternatives

The following sections describe selected aspects of illustrative autoloading rivet installation devices as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Schematic Example of an Autoloading Rivet Installation Device

As schematically illustrated in FIG. 1, This section describes an illustrative autoloading rivet installation device 10. Automatic-loading rivet installation device 10, also referred to as am autoloading rivet gun, is configured to automatically load rivets into the rivet gun, to assist in the rivet installation process, and to capture at least some of the debris generated by the process.

Rivet installation device 10 includes a rivet gun 12. Rivet gun 12 may include any suitable device configured to assist in the installation of rivets (e.g., blind rivets). For example, rivet gun 12 may include a hand-held automatic, semiautomatic, or manual rivet gun. Rivet gun 12 is configured to install rivets by deforming the head of the rivet, e.g., by exerting a pulling force on the stem of a rivet to deform the head of the rivet, thereby fixing the rivet in place. In examples where rivet gun 12 is automatic or semiautomatic, a power source is included to provide the rivet-pulling force, e.g., a pneumatic, hydraulic, and/or electrical power source. For example, rivet gun 12 may be coupled to a source of pneumatic pressure.

Rivet gun 12 comprises a body 13, which includes features configured to facilitate operation by a user or machine, such as a handle, trigger, user interface, etc. Rivet gun 12 has a longitudinal plane 18, generally described as a vertical plane passing through a long axis or centerline of body 13. Rivet gun 12 further comprises an end portion 16 configured to hold a rivet during installation. In some examples, end portion 16 is disposed at a front end of the rivet gun. In some examples, end portion 16 is a nose 17 of rivet gun 12. Nose 17 may include any suitable device or mechanism suitable for holding rivets, including but not limited to claws, clips, channel(s), etc. In some examples, nose 17 is automatically operated. For example, nose 17 may automatically hold and/or grasp onto a rivet in response to the rivet being inserted into an opening of nose 17. In some examples, end portion 16 of rivet gun 12 is configured to facilitate the installation of rivets. For example, end portion 16 of the rivet gun may be configured to exert a pulling force on the stem of a rivet, deforming the rivet head and fixing it within any holes the rivet intersects.

In some examples, each of the rivets loaded into end portion 16 of rivet gun 12 include a driving anvil washer, which is utilized only during installation (rather than being retained on the rivet) and typically becomes the ferromagnetic debris later captured by the apparatus. Driving anvil washers are configured to provide a surface for the rivet gun to push against during deformation of the rivet head. Accordingly, any component suitable for providing such a workpiece for the rivet gun while fitting onto the rivet itself may be used as an alternative to the washer.

Autoloading rivet installation device 10 includes an automatic loader 14, which may include any suitable device configured to retrieve rivets from a source and to load rivets into end portion 16 of the rivet gun. In some examples, automatic loader 14 may be positioned adjacent to rivet gun 12 on a lateral side. Other positions are possible, however, and automatic loader 14 may be positioned on a dorsal side or ventral side of rivet gun 12. Automatic loader 14 may comprise multiple different components, and each of these components may be disposed at or adjacent different regions on rivet gun 12. In some examples, automatic loader 14 is integral with rivet gun body 13. In some examples, automatic loader 14 is coupled to rivet gun 12. For example, automatic loader 14 may be a modular, removable attachment.

To load rivets, automatic loader 14 utilizes and/or is coupled to the rivet gun by one or more actuators configured to manipulate the loader. For example, automatic loader 14 may include a first actuator 20 configured to position a load arm 26 of the loader and a second actuator 24 configured to reposition the loader as a whole. In some examples, an electronic controller 56 is used to operate automatic loader 14, including first actuator 20 and/or second actuator 24. Electronic controller 56 may include any device suitable for operating the automatic components of autoloading rivet installation device 10. For example, the controller may include one or more of an electronic controller, a programmable logic controller (PLC), a dedicated controller, a special-purpose controller, a personal computer, a special-purpose computer, a display device, a logic device, a memory device, and/or a memory device having non-transitory computer readable media suitable for storing computer-executable instructions for implementing aspects of systems and/or methods according to the present disclosure.

In some examples, automatic loader 14 is configured to load rivets into end portion 16 of rivet gun 12 using first actuator 20. First actuator 20 may include any actuator configured to transition load arm 26, such as an electric, pneumatic, hydraulic, and/or mechanical actuator. In some examples, first actuator 20 comprises a first linear actuator.

First actuator 20 comprises a shaft 22 and is configured to transition shaft 22 forward and backward relative to rivet gun 12. In some examples, shaft 22 is oriented parallel to longitudinal plane 18 of rivet gun 12 and the forward and backward motion is parallel to longitudinal plane 18.

As schematically illustrated in dashed lines in FIG. 1, first actuator 20 may comprise a pneumatic or hydraulic cylinder 30. Cylinder 30 is configured to extend and retract a shaft, and may be mounted to or in a chamber or railing of first actuator 20. In some examples, first actuator 20 is configured to rotate shaft 22 while extending and retracting, e.g., using a single curved (e.g., helical) cam groove engaged by a pin. In some examples, a helical spline mechanism may be used. Accordingly, shaft 22 is configured to extend and rotate in response to cylinder 30 extending and retracting. The direction of rotation depends on the overall configuration of autoloading rivet installation device 10. In some examples, first actuator 20 is configured to rotate shaft 22 independently of the extension/retraction motion, e.g., using a separate rotary actuator. Accordingly, first actuator 20 includes a rotation mechanism 31 configured to rotate cylinder 30, shaft 22, and/or loader arm 26.

Automatic loader 14 may further include a second actuator 24 configured to translate loader arm 26 left and right. In some examples, second actuator 24 is oriented orthogonally with respect to first actuator 20. In some examples, second actuator 24 is configured to transition a portion of automatic loader 14 toward and away from rivet gun body 13. For example, second actuator 24 may be configured to transition first actuator 20 toward and away from body 13 of rivet gun 12. Additionally or alternatively, second actuator 24 may be configured to transition first actuator 20 at angle relative to rivet gun 12.

In some examples, second actuator 24 is a linear actuator. As schematically illustrated in dashed lines in FIG. 1, second actuator 24 may include a pneumatic or hydraulic cylinder 32, and may be configured to translate first actuator 20 toward and away from body 13 of rivet gun 12. Second actuator 24 may be coupled to first actuator using any suitable mechanism or method, including by a railing, a sliding tray, etc.

In some examples, automatic loader 14 further comprises loader arm 26 (also referred to as the arm or loading arm or load arm). Arm 26 may include any suitable structure or mechanism configured to retrieve rivets from a rivet queue or rivet dispenser 40 (e.g., one at a time) and hold each of the rivets as they are transported to nose 17 of rivet gun 12. In some examples, arm 26 is connected to shaft 22 of the automatic loader. For example, arm 26 may be coupled to a distal end of shaft 22. In some examples, arm 26 extends orthogonally from shaft 22 and is moved by shaft 22 (e.g., longitudinally and/or rotationally).

A magnet 28 is disposed on arm 26 and is configured to capture ferromagnetic debris in the nearby vicinity. Magnet 28 may be integral with arm 26 or, alternatively, coupled to arm 26 using a fastener. In some examples, magnet 28 includes a plurality of magnets. Different types or combinations of magnets may be used, such as permanent magnets, electromagnets, rare earth magnets, ceramic magnets, alnico magnets, flexible magnets, etc. For example, magnet 28 may be an electromagnet, and electronic controller 56 may be configured to activate magnet 28 selectively to accomplish retrieval of ferromagnetic debris. In some examples, magnet 28 is positioned on a distal end of arm 26 away from the first and/or second actuators. In some examples, magnet 28 is positioned on a side of arm 26 that faces away from rivet gun 12. Magnet 28 is configured to capture debris not regularly retrieved in known automatic rivet guns, and advantageously prevents the accumulation of foreign object debris (FOD).

Arm 26 may include a rivet holder 38. Rivet holder 38 may include any suitable device configured to retrieve, hold, and place rivets, including a claw, channel, and/or magnet, etc. In combination with the first actuator, load arm 26 and holder 38 combine to form a pick-and-place mechanism for rivets. In some examples, rivet holder 38 is positioned on a side opposite from magnet 28. For example, if magnet 28 is positioned on a side of arm 26 that faces away from rivet gun 12, rivet holder 38 is positioned on the side of arm 26 that faces rivet gun 12. In some examples, rivet holder 38 and magnet 28 are positioned on the same side of arm 26. For example, magnet 28 may be disposed on both sides of arm 26, while rivet holder 38 is disposed on a side facing rivet gun 12.

Second actuator 24 is configured to transition arm 26 and first actuator 20 left and right, between a plurality of positions relative to the central longitudinal plane of the rivet gun.

As schematically illustrated in dashed lines in FIG. 1, autoloading rivet installation device 10 may include rivet dispenser 40. Rivet dispenser 40 may include any suitable rivet-dispensing apparatus configured to transfer rivets from a rivet supply to be presented (e.g., one at a time) to load arm 26. Rivet dispenser 40 has a front end 40A and a back end 40B. Front end 40A may include a dispenser nozzle.

In some examples, the rivets are first sorted by a vibratory bowl or other apparatus configured to orient the rivets in a common selected direction. For example, back end 40B of rivet dispenser 40 may be coupled to a tube that leads to the vibratory bowl.

As mentioned above, autoloading rivet installation device 10 may include a sensor 36 configured to detect debris from the rivets. Sensor 36 may include any suitable sensor or sensing device configured to detect the presence and/or trajectory of debris around autoloading rivet installation device 10. For example, sensor 36 may be a proximity sensor configured to detect ferromagnetic material and/or debris. Sensor 36 may be in communication with electronic controller 56. In some examples, in response to detection of an item of debris, electronic controller 56 is configured to operate the first and/or second actuator to transition the arm and magnet to capture the debris. In some examples, sensor 36 is located on the rivet gun body 13. However, sensor 36 may be located at any suitable location configured to enable detection of debris, such as on the first actuator 20 or second actuator 24, on arm 26 (e.g., disposed adjacent to magnet 28), etc. In some examples, sensor 36 is absent and controller 56 is configured to transition the arm and magnet to a predetermined position (e.g., fully extended to the right) as soon as riveting operation is complete and/or in response to the user interacting with a button or other interface element.

Rivet gun 12 may include an integral vacuum system 34 configured to capture the severed stem of each rivet. Integral vacuum system 34 may be coupled to rivet gun body 13 and may be aligned with longitudinal plane 18. Additionally or alternatively, integral vacuum system 34 may be configured to capture additional debris from each rivet, such as severed parts from the head of each rivet. Integral vacuum system 34 has an entrance 34A and an exit 34B. Entrance 34A is configured to take in rivet stems and/or other debris. Exit 34B is configured to dispose of debris and/or connect to a collection device.

B. Illustrative Autoloading Rivet Installation Device

Figure 2:
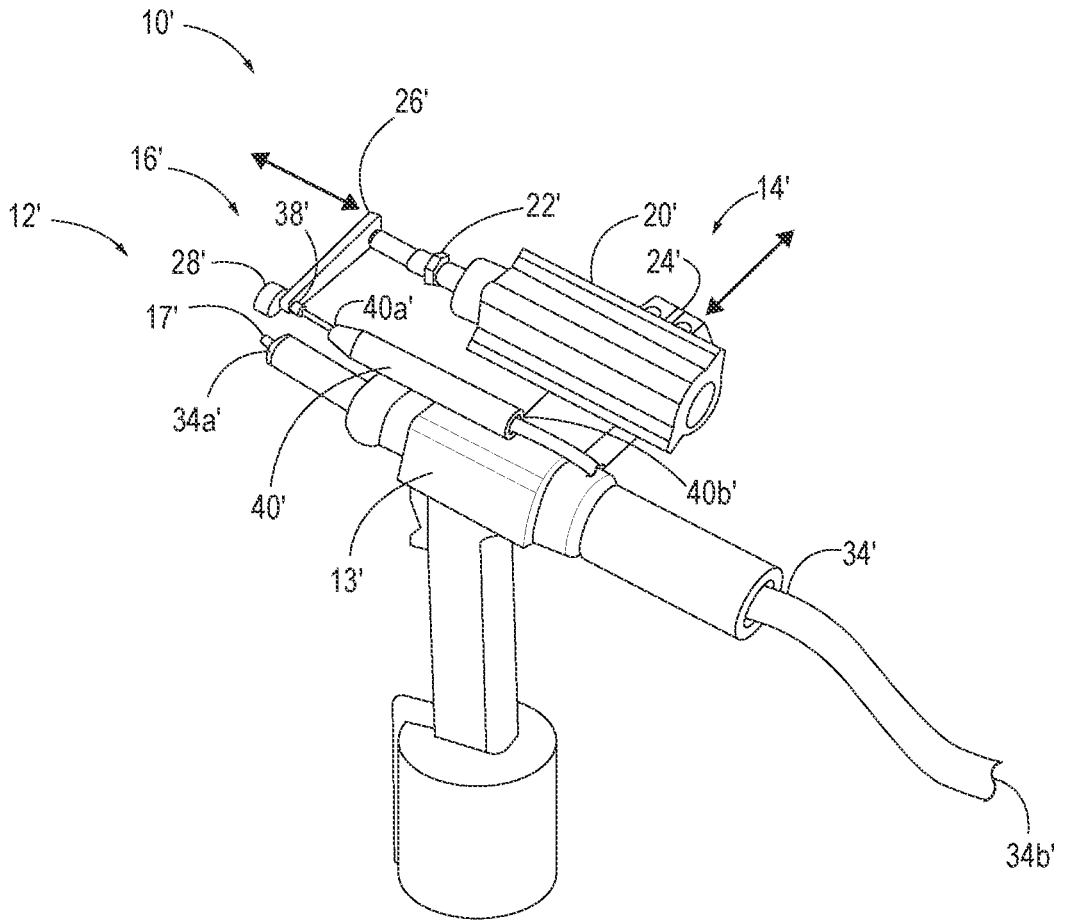
FIG. 2 is a first perspective view of an example of the autoloading rivet installation device of FIG. 1.
Figure 3:
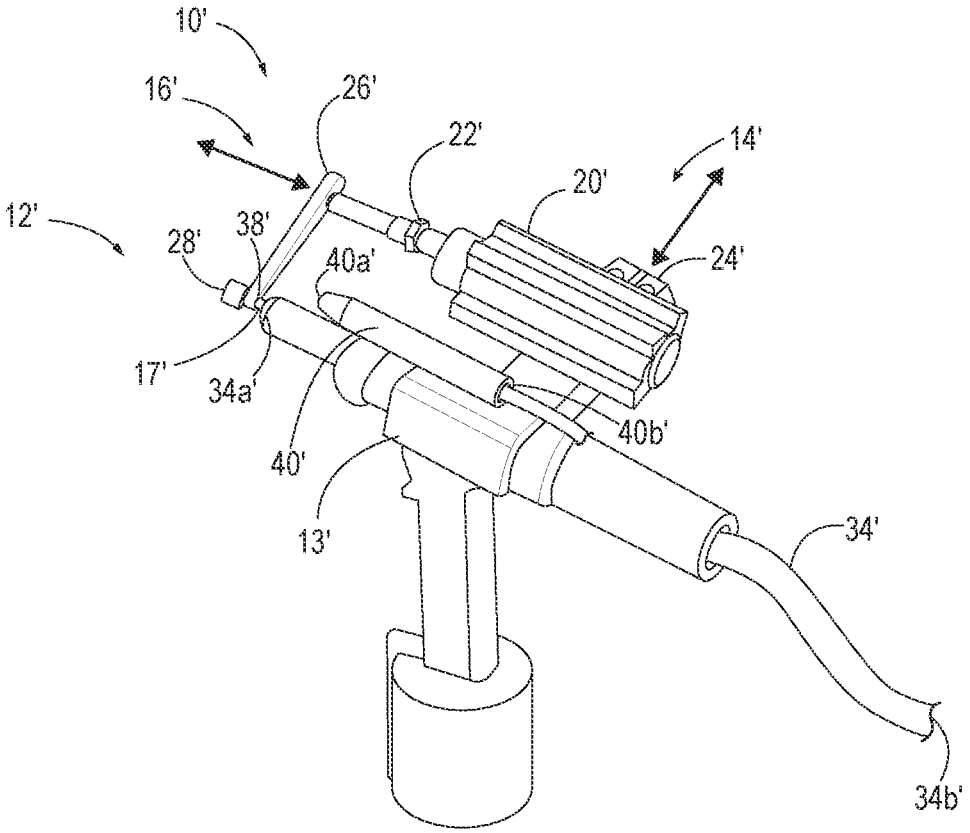
FIG. 3 is a second perspective view of the rivet installation device of FIG. 2.
Figure 4:
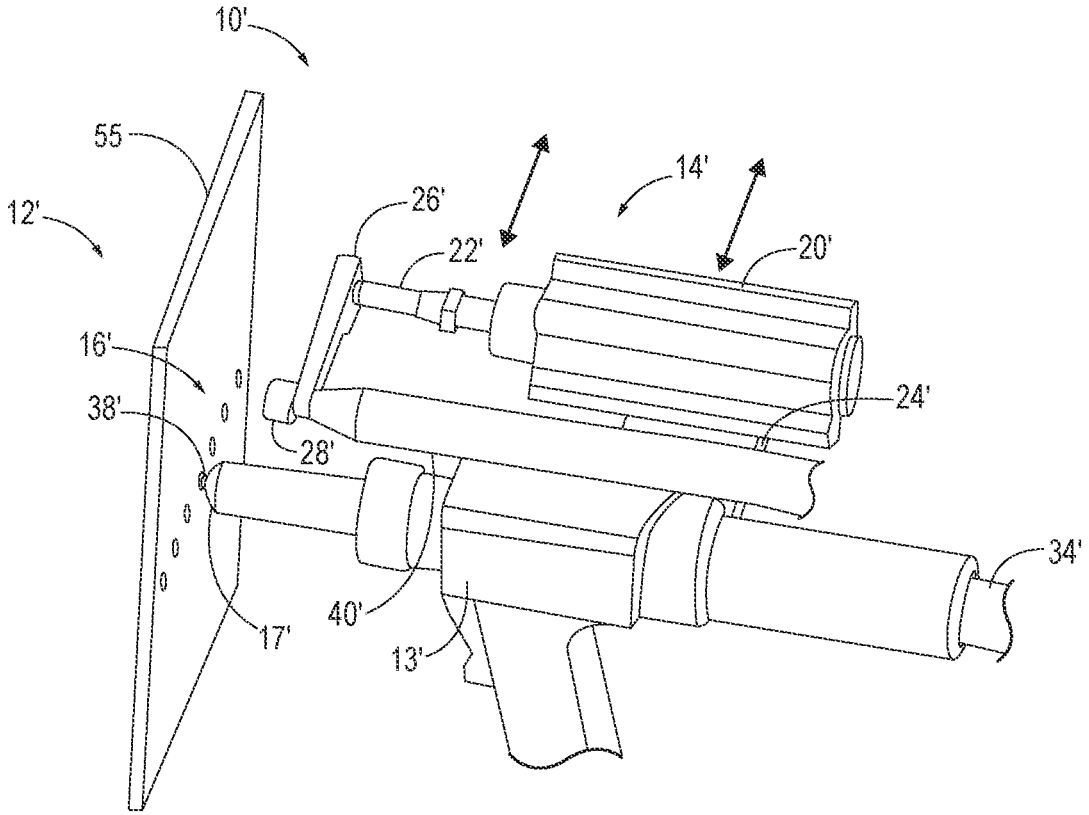
FIG. 4 is a third perspective view of the rivet installation device of FIG. 2.

As illustrated in FIGS. 2-4, this section describes an illustrative embodiment of the autoloading rivet installation device described generally above, namely device 10'. For brevity, each previously discussed component, part, portion, aspect, region, etc. or variants thereof may not be discussed, illustrated, and/or labeled again with respect to the examples of FIGS. 2-4. However, it is within the scope of the present disclosure that the previously discussed features, variants, etc. may be utilized with the examples of FIGS. 2-4.

Autoloading rivet installation device 10' includes a hand-held rivet gun 12' and an automatic loader 14' configured to load rivets into an end 16' of rivet gun 12'. Automatic loader 14' is positioned on a lateral side of rivet gun 12' and uses a first actuator 20' having a shaft 22' oriented parallel to a long axis of the rivet gun to load rivets. First actuator 20' is coupled to the rivet gun by way of a second actuator 24', second actuator 24' having an orientation orthogonal to first actuator 20'.

A load arm 26' is coupled to a distal end of shaft 22' and comprises a magnet 28' and a rivet holder 38'. Magnet 28' is configured to attract and capture ferromagnetic materials and is disposed on a distal end of arm 26' on a side facing away from rivet gun 12' (in other words, on a workpiece-facing side of arm 26'). Rivet holder 38' is disposed on a side opposite magnet 28' and faces toward rivet gun 12'. A rivet dispenser 40' is coupled to a ventral side of rivet gun 12', in this case set back from front end 16'.

FIG. 2 illustrates autoloading rivet installation device 10' in a first position, in which the loader is at rest and/or a rivet is being retrieved from the rivet dispenser. In the first position, magnet 28' is spaced away from end 16' of rivet gun 12'. In some examples, magnet 28' is spaced apart from end 16' of rivet gun 12' in a position above end 16' and toward a medial portion of rivet gun body 13'. Other positions are possible. In some examples, when in the first position, rivet dispenser 40' is adjacent to a portion of the automatic loader 14'. In the example illustrated in FIG. 2, rivet dispenser 40' is adjacent to arm 26' when autoloading rivet installation device 10' is in the first position. Rivet holder 38' may then receive a rivet from rivet dispenser 40'. Arm 26' is, in some examples, rotated clockwise while moving toward the first position.

From the first position, arm 26' may be moved to a variety of other positions using either or both actuators 20', 24' and/or a rotary mechanism. For example, arm 26' may remain in first position, move to the left or right, and/or move to the second position. In some examples, to transition to the first position, shaft 22' is retracted into first actuator 20'. As described above, in some examples, retracting shaft 22' causes a rotation motion along with a linear motion. Accordingly, the load arm may be moved back from end 16' of rivet gun 12' and above rivet gun body 13'.

FIG. 3 illustrates device 10' in a second position, in which the rivet is being loaded into the nose of the gun. In the second position, arm 26' is positioned adjacent to end 16' of rivet gun 12'. As such, arm 26' may load rivets in to rivet gun 12'. Arm 26', in some examples, is rotated counterclockwise while moving toward the second position. In some examples, when in the second position magnet 28' may be utilized to capture debris. In some examples, the second position is a clean-up position, where magnet 28' is positioned in front of end 16' to manually capture stationary debris (e.g., to "clean" the workstation of ferromagnetic material and/or debris).

Although two positions are illustrated in FIGS. 2-4, these positions may be attained using only the first actuator, while several other positions are possible using the first and second actuator in concert. For example, during debris capture, first actuator 20' and arm 26' may be repositioned away (to the right, from a user's perspective) from longitudinal plane 18' of rivet gun 12' due to the action of second actuator 24'. Positions and/or configurations of arm 26' and/or automatic loader 14' are determined by the respective extents (i.e., the maximum movement allowed) of first actuator 20' (including shaft 22' and cylinder 30') and second actuator 24'. In some examples, movement during debris capture involves rotating arm 26'. For example, moving forward to capture debris may rotate arm 26'. In some examples, arm 26' maintains the same rotational angle relative to shaft 22' during transition.

FIG. 4 illustrates autoloading rivet installation device 10' installing a rivet in workpiece 55. Workpiece 55 may include any suitable structure(s) or material(s) configured to be fastened together using rivets. A face of workpiece 55 may be oriented for ease of riveting, e.g., substantially vertically or substantially horizontally. Regardless of the orientation of workpiece 55, autoloading rivet installation device 10' is configured to install rivets into workpiece 55 and to capture debris generated by the installation process.

To facilitate installation of a rivet, load arm 26' and magnet 28' may be moved away from end 16' of rivet gun 12' in either direction (left or right). In the example depicted in FIG. 4, magnet 28' is moved to a position substantially similar to the first position depicted in FIG. 2. The loader may be configured to remain idle or to retrieve another rivet while the previous rivet is being installed. Once a rivet is installed, second actuator 24' may act immediately to reposition load arm 26' and magnet 28' sideways to capture debris near workpiece 55. In some examples, magnet 28' transitions to capture debris after a delay in response to sensor 36' detecting the presence of debris.

C. Illustrative Method of Using the Autoloading Rivet Installation Device

This section describes steps of a first illustrative method for installing rivets using autoloading rivet installation device. Aspects of autoloading rivet installation device 10 may be utilized in the method steps described below. Where appropriate, reference may be made to components and systems that may be used in carrying out each step. These references are for illustration, and are not intended to limit the possible ways of carrying out any particular step of the method.

Figure 5:
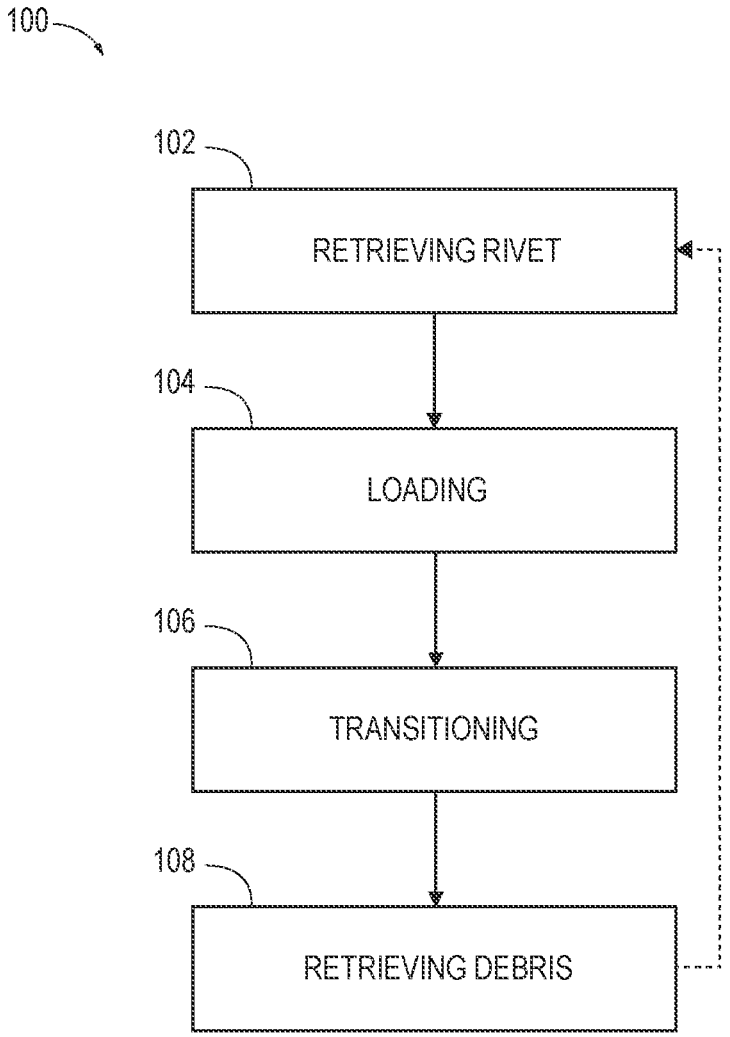
FIG. 5 is a flowchart depicting steps of a method for operating an autoloading rivet installation device in accordance with aspects of the present disclosure.

FIG. 5 is a flowchart depicting steps of an illustrative method 100. Devices described elsewhere in this disclosure may be utilized in carrying out the steps of method 100. For example, electronic controller 56 may be configured to control the actuators of rivet gun 12 and automatic loader 14 in accordance with method 100. The methods and steps illustrated in FIG. 5 are not limiting and other methods and steps are within the scope of the present disclosure, including methods having greater than or fewer than the number of steps illustrated, as understood from the discussions herein.

Step 102 of method 100 comprises retrieving a rivet from an onboard rivet dispenser using a load arm coupled to a first actuator of a rivet gun. For example, rivets may be dispensed from a pneumatic dispenser, a magazine, or any other suitable dispensing device configured to present rivets to the load arm. In some examples, the first actuator comprises a first linear actuator. In some examples, the first actuator comprises a cylinder and the load arm is coupled to a shaft of the cylinder. The first linear actuator may comprise a pneumatic or hydraulic cylinder. In some examples, the shaft of the cylinder of the first actuator defines an axis of rotation of the load arm. In some examples, the load arm extends orthogonally from the shaft of the cylinder.

Step 104 of method 100 includes loading the rivet into an end of the rivet gun using the load arm and the first actuator. For example, the first actuator may extend and/or rotate to transition the load arm from the dispenser to the nose of the rivet gun. Each of the rivets loaded into the end of the rivet gun may include a driving anvil washer, such that the item of ferromagnetic debris being retrieved in later step 108 comprises the driving anvil washer. In some examples, loading the rivet into the end of the rivet gun includes transitioning the load arm in a direction parallel to a longitudinal plane of the rivet gun. In some examples, loading the rivet into the end of the rivet gun further includes rotating the load arm. For example, rotating the load arm may include using a cam and cam follower, a pin and a curved channel, or a dedicated rotary actuator.

Step 106 of method 100 includes transitioning the load arm of the automatic loader to a position away from the end of the rivet gun using the first actuator. The load arm may be repositioned in a first direction to avoid interfering with the riveting process. In some examples, the load arm is transitioned back to its original position adjacent the rivet dispenser (e.g., to the left if using device 10'). In some examples, the load arm is transitioned to the right or to a position above or below the rivet gun.

In response to installation of the rivet by the rivet gun, step 108 of method 100 includes retrieving an item of ferromagnetic debris using a magnet coupled to the load arm, wherein retrieving the item includes automatically repositioning the load arm in a lateral direction using a second actuator oriented orthogonal to the first actuator. In some examples, the load arm is translated in a second direction (e.g., opposite the first direction). In some examples, the second actuator comprises a second linear actuator and/or a rotary actuator. In some examples, the second linear actuator comprises a pneumatic or hydraulic cylinder.

Retrieving debris in step 108 may include repositioning the load arm to a predetermined position relative to the rivet gun (e.g., fully extended to one side by the second actuator). In some examples, repositioning may be done dynamically using one or both of the first and second actuators based on an expected position of the debris or on an anticipated or known position as determined by one or more sensors of the device. Step 108 may be manually or automatically triggered (e.g., in response to completion of a riveting action by the gun).

One or more of the steps of method 100 may be carried out automatically or semiautomatically, e.g., by controlling the first and/or second actuators using an electronic controller. In some examples, the user may trigger or signal completion of certain steps or activities, e.g., using a user interface element (e.g., a manual trigger, a button, voice commands, gesture controls, etc.).

D. Illustrative Programmable Logic Controller

Figure 6:
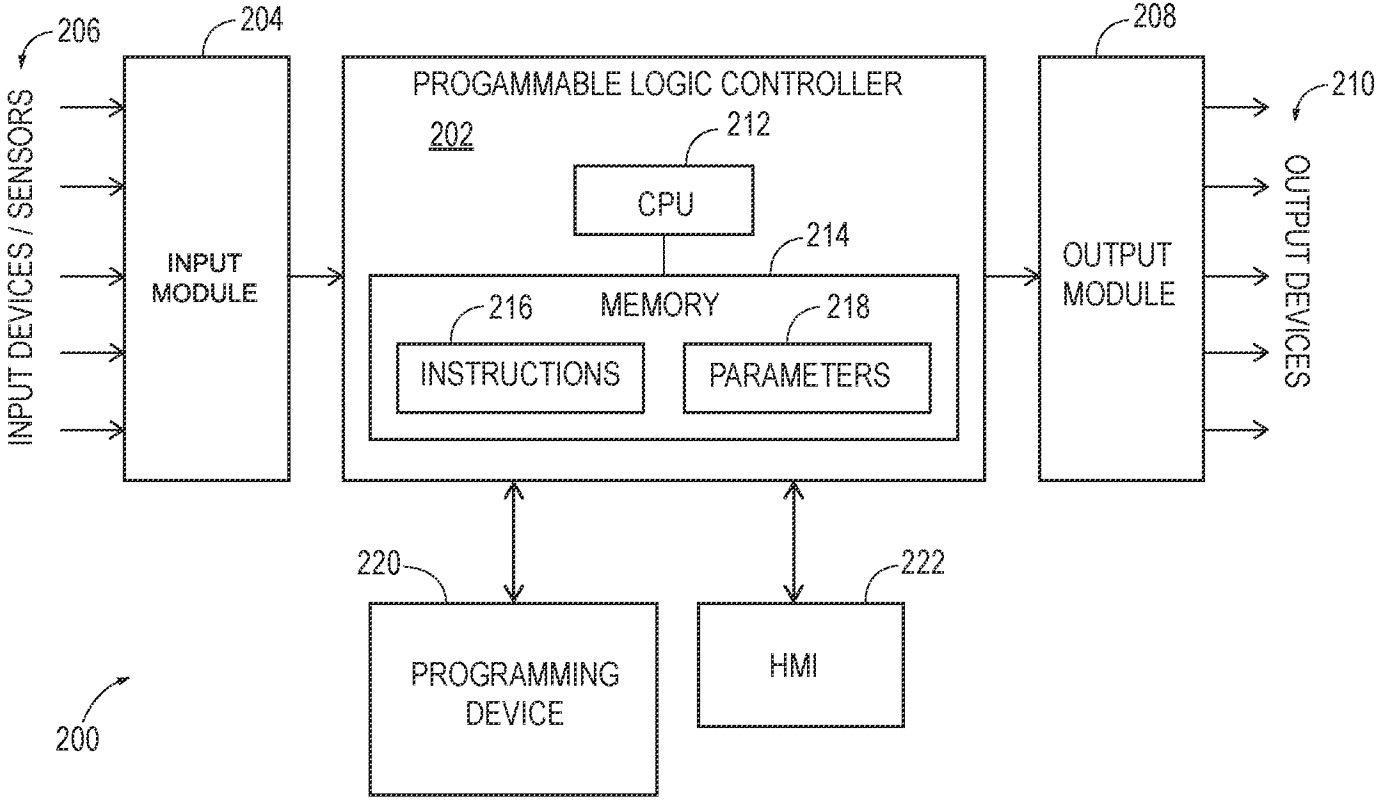
FIG. 6 is a schematic diagram of a programmable logic controller suitable for use in devices and methods of the present disclosure.

As shown in FIG. 6, this section describes an illustrative programmable logic controller system 200 (also referred to as a PLC system) suitable for implementing aspects of autoloading rivet installation device controls in accordance with aspects of the present disclosure. PLC system 200 is a programmable controller used for automation of typical industrial processes. In some examples, devices that are embodiments of a programmable logic controller system may be included in electronic controller 56 and/or automatic loader 14, including first actuator 20 and second actuator 24.

In this illustrative example, PLC system 200 includes a programmable logic controller (PLC) 202, also referred to as a controller. PLC 202 includes a central processing unit (CPU) 212, and a memory 214 for storing instructions 216 and parameters 218 necessary to carry out the relevant automation tasks.

Central processing unit 212 serves to execute software programs in the form of instructions 216. The software programs may be loaded into memory 214. Memory 214 may also store parameters 218 needed for operation. A programming device 220 may interface with PLC 202 to facilitate the input of instructions and settings and/or to monitor equipment operation. Programming device 220 may include, for example, a handheld computer or personal computer.

A human machine interface (HMI) 222 may also be placed in communication with PLC 202. HMI 222 facilitates a user-friendly and interactive interface with the system processes and controls. Human machine interface 222 may also assist an operator in determining machine conditions, in changing machine settings, and/or displaying faults.

PLC system 200 includes an input module 204 in receiving communication with one or more input devices/sensors 206, and an output module 208 in outgoing communication with one or more output devices 210. Both modules 204 and 208 are hardware devices in communication with PLC 202. In some examples, communication with PLC 202 may be carried out via an optical (or otherwise wireless) interface, such that PLC 202 is electrically isolated from the input and output modules.

Input module 204 may convert analog signals from input devices/sensors 206 into digital and/or logic signals that the PLC can use. Signal types may be digital or analog. With these signals the CPU may evaluate the status of the inputs. Upon evaluating the input(s), along with known output states and stored program parameters and instructions, the CPU may execute one or more predetermined commands to control the one or more output devices. Output module 208 may convert control signals from the CPU into digital or analog signals which may be used to control the various output devices.

HMI 222 and programming device 220 may provide for communications with other electronic controllers or devices, e.g., through the use of physical and/or wireless communications links.

Modules 204 and 208 allow for input and output of data with other devices that may be connected to PLC 202. For example, input module 204 may provide a connection for temperature or pressure measurements, valve or machine status, tank level status, user input through a keyboard, a mouse, and/or any other suitable input device. Output module 208 may send output to an actuator, indicator, motor controller, printer, machine, display, and/or any other suitable output device.

E. Illustrative Examples and Combinations of Features

Illustrative, non-exclusive examples of inventive subject matter according to the present disclosure are described in the following enumerated paragraphs:

A1. An autoloading rivet installation device (10), comprising:

a hand-held rivet gun (12);

an automatic loader (14) configured to load rivets into an end (16) of the rivet gun (12) using a first actuator (20) having a shaft (22) oriented parallel to a longitudinal plane (18) of the rivet gun (12); and a second actuator (24) coupled to the rivet gun (12) and having an orientation orthogonal to the first actuator (20), wherein the second actuator is configured to transition a magnet (28) laterally between a plurality of positions relative to the longitudinal plane (18) to capture ferromagnetic debris.

A2. The device of A1, wherein each of the rivets loaded into the end (16) of the rivet gun (12) includes a driving anvil washer, and the ferromagnetic debris comprises one or more of the driving anvil washers.

A3. The device of A1 or A2, wherein the automatic loader (14) comprises an arm (26) coupled to the shaft (22) of the first actuator (20), and the magnet (28) is coupled to the arm (26).

A4. The device of A3, wherein the arm (26) extends orthogonal to the shaft (22) and is configured to rotate about an axis of rotation defined by the shaft (22).

A5. The device of any one of A1 through A4, wherein the first actuator (20) comprises a pneumatic or hydraulic cylinder (30).

A6. The device of A4 or A5, wherein the first actuator (20) is configured to rotate the shaft (22) while extending and retracting.

A7. The device of any one of A1 through A6, wherein the second actuator (24) comprises a second linear actuator.

A8. The device of A7, wherein the second linear actuator comprises a pneumatic or hydraulic cylinder.

A9. The device of any one of A1 through A8, wherein the second actuator (24) is configured to translate the first actuator (20) toward and away from the longitudinal plane (18) of the rivet gun (13).

A10. The device of any one of A1 through A9, wherein the rivet gun (12) is configured to capture a severed stem of each rivet using an integral vacuum system (34).

A11. The device of any one of A1 through A10, wherein the rivet gun (12) further comprises a proximity sensor (36) configured to detect the ferromagnetic debris.

B1. A method of using a rivet gun, the method comprising:

retrieving a rivet from an onboard rivet dispenser using a load arm coupled to a first actuator of a rivet gun;

loading the rivet into an end of the rivet gun using the load arm and the first actuator;

transitioning the load arm of the automatic loader to a position away from the end of the rivet gun using the first actuator; and in response to installation of the rivet by the rivet gun, retrieving an item of ferromagnetic debris using a magnet coupled to the load arm, wherein retrieving the item includes automatically repositioning the load arm in a lateral direction using a second actuator oriented orthogonal to the first actuator.

B2. The method of paragraph B1, wherein loading the rivet into the end of the rivet gun includes transitioning the load arm in a direction parallel to a longitudinal plane of the rivet gun.

B3. The method of paragraph B2, wherein the first actuator comprises a cylinder and the load arm is coupled to a shaft of the cylinder.

B4. The method of paragraph B3, wherein loading the rivet into the end of the rivet gun further includes rotating the load arm.

B5. The method of paragraph B4, wherein the shaft of the cylinder of the first actuator defines an axis of rotation of the load arm.

B6. The method of paragraph B4 or B5, wherein rotating the load arm comprises using a cam and cam follower.

B7. The method of any one of paragraphs B3 through B6, wherein the load arm extends orthogonally from the shaft of the cylinder.

B8. The method of any of paragraphs B1 through B7, further comprising controlling the first and second actuators using an electronic controller.

B9. The method of any of paragraphs B1 through B8, wherein the first actuator comprises a first linear actuator.

B10. The method of paragraph B9, wherein the first linear actuator comprises a pneumatic or hydraulic cylinder.

B11. The method of any of paragraphs B1 through B10, wherein the second actuator comprises a second linear actuator.

B12. The method of paragraph B11, wherein the second linear actuator comprises a pneumatic or hydraulic cylinder.

B13. The method of any of paragraphs B1 through B12, wherein each of the rivets loaded into the end of the rivet gun includes a driving anvil washer, and the item of ferromagnetic debris comprises the driving anvil washer.

C1. An autoloading rivet installation device comprising:

a rivet gun (12) defining a longitudinal plane (18);

a loading arm (26) coupled to a first actuator (20), wherein the loading arm (26) is configured to load rivets into a nose (17) of the rivet gun (12), wherein the first actuator (20) is configured to extend and retract the loading arm (26) parallel to the longitudinal plane (18); and a second actuator (24) coupled to the rivet gun (12), wherein the second actuator (24) is configured to translate the first actuator (20) in directions orthogonal to the longitudinal plane (18).

C2. The device of C1, wherein the loading arm comprises a magnetic portion configured to attract ferromagnetic debris generated by the rivet installation device.

C3. The device of any one of C1 through C2, wherein the first actuator comprises a hydraulic or pneumatic cylinder.

C4. The device of C3, wherein the loading arm extends orthogonally from a shaft of the cylinder.

C5. The device of any one of C1 through C4, wherein the first actuator is further configured to rotate the loading arm.

C6. The device of C5, wherein the first actuator is configured to rotate the loading arm while extending and retracting.

C7. The device of any one of C1 through C6, wherein the first actuator is configured to position the loading arm away from the nose of the rivet gun during rivet installation.

C8. The device of any one of C1 through C7, wherein the device is configured to utilize blind rivets having washers.

C9. The device of any one of C1 through C8, wherein the rivet gun further comprises an integral vacuum system configured to capture a severed stem of each rivet.

C10. The device of any one of C1 through C9, wherein the second actuator is a linear actuator comprising a pneumatic or hydraulic cylinder.

C11. The device of any one of C1 through C10, wherein the rivet gun further comprises a proximity sensor configured to detect ferromagnetic debris.

C12. The device of C11, wherein the second actuator is configured to position the loading arm to capture the ferromagnetic debris in response to the proximity sensor detecting the ferromagnetic debris.

C13. The device of any one of C1 through C12, further comprising an electronic controller configured to control operation of the first and second actuators.

D1. The use of autoloading rivet installation device 10 to install rivets.

Definitions

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Comprising," "including," and "having" (and conjugations thereof) are used interchangeably to mean including but not necessarily limited to, and are open-ended terms not intended to exclude additional, unrecited elements or method steps.

Terms such as "first," "second," and "third" are used to distinguish or identify various members of a group, or the like, and are not intended to show serial or numerical limitation.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

Advantages, Features, and Benefits

The different embodiments and examples of the autoloading rivet installation device and the methods for using such a device described herein provide several advantages over known solutions for installing rivets and capturing debris. For example, illustrative embodiments and examples described herein teach a rivet gun capable of capturing multiple types of debris generated by rivet installation.

Additionally, and among other benefits, illustrative embodiments and examples described herein improve efficiency of rivet installation by automatically or semiautomatically reducing debris present in the working environment.

Additionally, and among other benefits, illustrative embodiments and examples described herein provide an automatic loader having more degrees of freedom than those known in the art.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred forms(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the carious elements, features, functions, and/or properties disclosed herein. The following claims particularly point out certain combinations and subcombinations of features, functions, elements, and/or properties may be claimed in applications claiming priority from this or a related application. Such claims, whether broader, narrower, equal, or different in scope to the original claims, also are regarded as included with the subject matter of the present disclosure.

The invention claimed is:

1. An autoloading rivet installation device, comprising:

a hand-held rivet gun;

an automatic loader configured to load rivets into an end of the rivet gun using a first linear actuator having a shaft oriented parallel to a longitudinal plane of the rivet gun, wherein the automatic loader comprises an arm coupled to the shaft of the first linear actuator, and a magnet is coupled to the arm, and wherein the arm extends orthogonal to the shaft and is configured to rotate about an axis of rotation defined by the shaft; and a second linear actuator coupled to the rivet gun and having an orientation orthogonal to the first linear actuator, wherein the second linear actuator is configured to translate the magnet between a plurality of positions toward and away from the longitudinal plane to capture ferromagnetic debris.

2. The autoloading rivet installation device of claim 1, wherein each of the rivets loaded into the end of the rivet gun includes a driving anvil washer, and the ferromagnetic debris comprises one or more of the driving anvil washers.

3. The autoloading rivet installation device of claim 1, wherein the first linear actuator comprises a pneumatic or hydraulic cylinder.

4. The autoloading rivet installation device of claim 1, wherein the first linear actuator is configured to rotate the shaft while extending and retracting.

5. The autoloading rivet installation device of claim 1, wherein the second linear actuator is configured to translate the first linear actuator toward and away from the longitudinal plane of the rivet gun.

6. The autoloading rivet installation device of claim 1, wherein the rivet gun is configured to capture a severed stem of each rivet using an integral vacuum system.

7. The autoloading rivet installation device of claim 1, wherein the rivet gun further comprises a proximity sensor configured to detect the ferromagnetic debris.

8. An autoloading rivet installation device comprising:

a rivet gun defining a longitudinal plane;

a loading arm coupled to a first actuator, wherein the loading arm is configured to load rivets into a nose of the rivet gun, wherein the first actuator is configured to extend and retract the loading arm parallel to the longitudinal plane, and wherein the first actuator has a shaft oriented parallel to the longitudinal plane, and wherein the loading arm extends orthogonal to the shaft and is configured to rotate about an axis of rotation defined by the shaft; and a second actuator coupled to the rivet gun, wherein the second actuator is configured to translate the first actuator in directions orthogonal to the longitudinal plane.

9. The autoloading rivet installation device of claim 8, wherein the loading arm comprises a magnetic portion configured to attract ferromagnetic debris generated by the rivet installation device.

10. An autoloading rivet installation device, comprising:

a hand-held rivet gun;

an automatic loader configured to load rivets into an end of the rivet gun using a first actuator having a shaft oriented parallel to a longitudinal plane of the rivet gun, wherein the first actuator is configured to rotate the shaft while extending and retracting; and a second actuator coupled to the rivet gun and having an orientation orthogonal to the first actuator, wherein the second actuator is configured to transition a magnet laterally between a plurality of positions relative to the longitudinal plane to capture ferromagnetic debris.

11. The autoloading rivet installation device of claim 10, wherein each of the rivets loaded into the end of the rivet gun includes a driving anvil washer, and the ferromagnetic debris comprises one or more of the driving anvil washers.

12. The autoloading rivet installation device of claim 10, wherein the first actuator comprises a pneumatic or hydraulic cylinder.

13. The autoloading rivet installation device of claim 10, wherein the second actuator is configured to translate the first actuator toward and away from the longitudinal plane of the rivet gun.

14. The autoloading rivet installation device of claim 10, wherein the rivet gun is configured to capture a severed stem of each rivet using an integral vacuum system.

15. The autoloading rivet installation device of claim 10, wherein the rivet gun further comprises a proximity sensor configured to detect the ferromagnetic debris.

16. The autoloading rivet installation device of claim 10, wherein the automatic loader comprises an arm coupled to the shaft of the first actuator, and the magnet is coupled to the arm.

17. The autoloading rivet installation device of claim 16, wherein the arm extends orthogonal to the shaft and is configured to rotate about an axis of rotation defined by the shaft.

* * * * *